United States Patent [19]

Okamoto et al.

[11] Patent Number: 4,734,686

[45] Date of Patent: Mar. 29, 1988

[54] GAS DISCHARGE DISPLAY APPARATUS

[75] Inventors: Takio Okamoto, Kusatsu; Ryoji Inutsuka; Yukiharu Ito, both of Osaka, all of Japan

[73] Assignee: Matsushita Electronics Corp., Japan

[21] Appl. No.: 932,598

[22] Filed: Nov. 20, 1986

[30] Foreign Application Priority Data

Nov. 20, 1985 [JP] Japan ..... 60-260152
Jun. 10, 1986 [JP] Japan ..... 61-134148

[51] Int. Cl.[4] ..... G09G 3/28

[52] U.S. Cl. ..... 340/713; 340/771; 340/805; 340/814

[58] Field of Search ..... 340/771, 758, 789, 805, 340/814, 713, 714

[56] References Cited

U.S. PATENT DOCUMENTS

| | | | |
|---|---|---|---|
| 3,798,501 | 3/1974 | Miller | 340/714 |
| 3,993,990 | 11/1976 | Miller et al. | 340/771 |
| 4,099,170 | 7/1978 | Maliszewski | 340/771 |
| 4,104,563 | 8/1978 | Schlig | 340/771 |
| 4,109,181 | 8/1978 | Murase et al. | 340/714 |
| 4,171,524 | 10/1979 | Lorteije | 340/771 |
| 4,189,729 | 2/1980 | Baker et al. | 340/771 |
| 4,328,489 | 5/1982 | Ngo | 340/713 |
| 4,329,616 | 5/1982 | Holz et al. | 340/714 |
| 4,333,039 | 1/1982 | Stram | 340/714 |
| 4,458,244 | 7/1984 | Yamaguchi et al. | 340/713 |

*Primary Examiner*—Howard A. Birmiel
*Attorney, Agent, or Firm*—Lowe, Price, LeBlanc, Becker & Shur

[57] ABSTRACT

A gas discharge display apparatus consisting of a gas discharge display panel and a drive circuit for driving a matrix array of display elements formed in the display panel by mutually perpendicular arrays of stripe-shaped anodes and cathodes, the cathodes being sequentially selected during successive scanning intervals and the anodes driven to produce a light-emitting or non-emitting state during each scanning interval in accordance with display data. During each scanning interval, each anode for which the non-emitting state is to be maintained is momentarily driven to the light-emitting state potential during a brief interval, to thereby substantially increase the reliability of display operation during the immediately succeeding scanning interval.

4 Claims, 10 Drawing Figures

GAS DISCHARGE DISPLAY APPARATUS

BACKGROUND OF THE INVENTION

The present invention relates to a gas discharge display apparatus consisting of a gas discharge display panel for displaying characters, graphics etc. by means of light emitted by electrical discharge in a gaseous plasma, and a drive circuit for driving the display panel.

FIG. 1 shows an oblique partial expanded view of a typical prior art example of a gas discharge display panel, while FIG. 2 shows a partial cross-sectional view of the display panel of FIG. 1. A plurality of anodes *2a, 2b, . . .* each formed as a thin stripe are successively arrayed at regular spacings along the vertical direction (which will be referred to in the following as the Y-direction) upon the inner surface of a plate member formed of an optically transparent material, i.e. a glass faceplate 1. A dielectric layer 3, a common electrode 4 which is coupled to a fixed potential, and an insulating layer 5 are sequentially formed over the anodes *2a, 2b, . . .*, in that order, to thereby constitute a plurality of capacitors which are coupled between respective ones of the anodes *2a, 2b, . . .* and the fixed potential. A plurality of cathodes *7a, 7b, . . .*, each formed as a thin stripe, are formed upon the inner face of a rear glass plate 6, aligned at regular spacings along the horizontal direction (referred to in the following as the X-direction), i.e. at right angles to the anodes. A plurality of dielectric partitioning members *8a, 8b, . . .* are arrayed along the Y-direction.

As shown in FIG. 2, the glass faceplate 1 and the rear glass plate 6 are mutually bonded to form an enclosed hermetically sealed chamber therebetween, by means of a layer 9 of a glass having a low melting point, which is formed around the peripheries of plates 1 and 6. A mixture of neon and argon gases together with a small quantity of mercury vapor is introduced at low pressure into the interior of the sealed chamber formed between plates 1 and 6. A gas discharge display panel having such a configuration is disclosed in various prior art references such as in Japanese patent provisional publication No. 54-151326.

With a gas discharge display panel having the configuration described above, a plurality of regions of mutual intersection are formed between the anodes *2a, 2b, . . .* and the cathodes *7a, 7b, . . .* Each of these regions constitutes a display element, i.e. a dot element which can be selectively set to a light-emissive or a non-emissive state. The light-emissive state of a dot element is established by applying a potential between the corresponding anode and cathode of sufficient amplitude to produce a relatively high level of current flow through the gas within the display panel, at that region of intersection, i.e. to produce a plasma discharge. The non-emissive state of a dot results when the amplitude of the potential applied between the corresponding anode and cathode is made sufficiently low that only a very low level of current flow occurs between the corresponding anode and cathode, whereby a substantially negligible level of light emission is produced from that dot element. This substantially non-emissive status will be referred to in the following as the slight discharge state, while the aforementioned light-emissive status will be referred to as the displaying discharge state.

The basic principles of operation of the gas discharge display panel described above will be described referring to the circuit diagram of FIG. 3, which shows the general configuration of a drive circuit for driving the display panel of FIGS. 1 and 2. In FIG. 3, one anode *2a* of the display panel of FIG. 1 is shown, together with five of the cathodes *7a. 7b, . . . 7e,* and typical drive circuit components connected thereto. Scanning along the Y-direction is performed by sequentially setting to the ON state (in the following, the closed state of a switch or the conducting state of a switching transistor will be referred to as the ON state, and the open state of a switch or the non-conducting state of a switching transistor as the OFF state) each of the cathode switches 1O*a, 1Ob, . . . 1Oe,* with each switch being left in the ON state during a fixed time interval referred to in the following as a cathode scanning interval. In this embodiment, each cathode is connected to ground potential during the corresponding cathode scanning interval, and is connected to a +100 V potential at all other times. The potential to which each cathode is connected during the corresponding cathode scanning interval will be referred to in the following as the cathode selection potential.

During such a cathode scanning interval, if for example anode switch 11*a* is set to the ON state, then a potential equal to the difference between the anode activation potential and the cathode selection potential will be applied between anode *2a* and the cathode which is currently selected. This potential difference is determined such that a high level of current flow will occur in the region of intersection of anode *2a* and the selected cathode, i.e. the display discharge state will be established for the corresponding display element. If on the other hand anode switch 11*a* is held in the open state, i.e. the OFF state during a cathode scanning interval, then (as described in detail hereinafter) only a very low amount of current will momentarily flow through the corresponding intersection region, i.e. the corresponding display element is held in the non-emissive discharge state.

The operation of the circuit of FIG. 3 is illustrated in the waveform diagram of FIG. 4, in which it is assumed that the display elements at the intersections of cathodes *7a* and *7c* and anode *2a* are set in the displaying discharge state, while the display elements at the intersections of cathodes *7b, 7d* and *7e* are set in the slight discharge state. FIG. 4(*a*) shows the corresponding ON/OFF switching sequence of anode switch 11*a,* while the corresponding waveforms of the potential Va of the anode *2a,* and the discharge current Ia which flows through anode *2a,* are respectively shown in FIGS. 4(*b*) and 4(*c*). The corresponding variations in potential of cathodes *7a, 7b, . . . , 7e* are shown in FIGS. 4(*d*), 4(*e*), . . . , 4(*h*) respectively. As shown, a blanking interval of duration $t_0$ is provided between each pair of successive cathode scanning intervals. Each cathode scanning interval is of duration $t_1$. One reason for providing these blanking intervals is that transistors are used to perform the functions of cathode switches 1O*a, 1Ob, . . . , 1Oe,* and switching delays will be introduced by these transistors. In order to prevent errors in operation being caused by these delay times, immediately after a cathode has been addressed during a cathode selection interval $t_1$, a slight discharge current flow is momentarily produced between that cathode and each anode corresponding to a display element which has not been set in the light-emitting state. This current flow is produced as follows. Due to the capacitance of anode *2a* for example, indicated by reference numeral 12 in FIG. 3 (assumed to have a value Cs), and the capacitance Ca of a capacitor 4a which is provided internally within the gas discharge display panel 1 and coupled to anode 2a, the potential Va of the anode 2a approaches a value Vs (determined by a power source 13) during each of the blanking intervals $t_0$. If the succeeding $t_1$ interval is an anode ON potential interval, i.e. an interval in which the anode switch 11a is held in the ON state, the anode potential Va will then fall to a discharge maintaining potential Vm and remain at that potential during that anode ON $t_1$ interval. A relatively high-amplitude discharge current Ia thereby flows through anode series resistor 14 (having resistance value Ra), with the value of this current Ia being equal to (Vs−Vm)/Ra.

If on the other hand the anode switch 11a is held in the OFF state during a $t_1$ interval following a $t_0$ interval, then the charge which has accumulated on the stray capacitance 12 of anode 2a and on capacitor 4a will be discharged during that $t_1$ interval, as a discharge current which flows through the region of intersection of anode 2a and the corresponding cathode. The magnitude of the stored charge Q which is thereby discharged is given as:

$$Q=(Cs+Ca)x(Vs-Vd)$$

where Vd is the anode potential upon completion of the discharging the stored charge. The resultant discharge through the gas between anode 2a and the corresponding cathode will be referred to as a slight discharge, in the following. This slight discharge is terminated after a short time has elapsed. As a result of such a slight discharge being periodically produced in each electrode intersection region at which the displaying discharge state is not produced, charged particles and excitation atoms become diffused within the adjacent intersection region (positioned above an immediately adjacent cathode to that which is currently selected) which will be addressed during the succeeding cathode scanning interval. This serves to improve the reliability of establishing the displaying discharge state, and to ensure a more rapid build-up of discharge current flow between anode and cathode to initiate that state, thereby ensuring more stable operation.

FIG. 5 is a block circuit diagram of a practical example of a prior art gas discharge display apparatus formed of a gas discharge display panel and drive circuit such as described above. A plurality of transistors 15a, 15b, . . . 15e which perform the functions of the cathode switches 10a, 10b, . . . 10e described above, are respectively connected to a scanning circuit 16. A horizontal sync signal (comprising a train of pulses having a period equal to $(t_0+t_1)$ and a vertical sync signal consisting of a train of pulses whose period determines the refresh rate of the display, are supplied to a scanning signal generating circuit 17. The scanning signal generating circuit 17 thereby supplies a scanning signal to scanning circuit 16, which determines the timings and durations of the blanking intervals $t_0$ and the cathode ON potential intervals $t_1$.

Control of anodes 2a, 2b, . . . , i.e. the control of data display, is executed by an anode switch circuit 18. This circuit performs the functions of anode switch 11 shown in FIG. 3, for each of the anodes 2a 2b, . . . , to control the application of discharge voltages to the respective anodes. The anode switch circuit 18 is controlled by output signals produced from a latch circuit 19, with these signals determining the timings at which switches within the anode switch circuit 18 are set to the ON and OFF (i.e. closed and open) states to thereby establish the displaying discharge state and the slight discharge state respectively of the display elements, in accordance with the data to be displayed. Upon completion of each cathode scanning interval, the display data which is to be displayed by the next cathode to be addressed is transferred to the latch circuit 19 from a shift register 20, under the control of a strobe signal which is applied to latch circuit 19 from a data read-in signal generating circuit 21. A charging signal generating circuit 22 applies a charging signal to the anode switch circuit during each of the cathode blanking intervals $t_0$. This charging signal acts to set each of the anodes 2a, 2b, . . . to the ON state for the duration of each of the cathode blanking intervals, as illustrated in FIG. 4(*a*). The above circuits, in conjunction with the anode coupling resistors 14 and the capacitors 4a serve to control the display operation. Each of the capacitors 4a has a capacitance value Ca which is approximately 20 picofarads, and serves to produce the slight discharge current flow described above, in conjunction with the stray capacitance 12 of the corresponding anode.

FIG. 6 shows an example of a specific circuit for anode switch circuit 18, while FIG. 7 shows waveforms at various points in the circuit of FIG. 6. In this example the anode switch circuit 18 consists of a set of switch circuits for the respective anodes 2a, 2b, . . . , 2z which are respectively designated as 18a, 18b, . . . ,18z. Each of these switch circuits 18a, 18b, . . . ,18z in this example consists of an OR gate 23 which is coupled to receive a data signal from latch circuit 19 and a charging signal from charging signal generating circuit 22, a FET 24a controlled by the OR gate 23 output, and an output transistor 24b which is controlled by the output from FET 24a. As shown, during each time interval $t_1$ in which cathode 7c, for example, is being scanned, display data signals representing data to be displayed by the next cathode in the scanning sequence (7d) is are supplied to shift register 20 in response to a series of shift clock pulses which are input to shift register 20. The display data signals are then transferred to the latch circuit 19 upon the rising edge of a strobe signal pulse which is produced from the data readout signal generating circuit 21. During the next cathode blanking interval $t_0$, a charging signal signal produced from the charging signal generating circuit 22 goes to the H (i.e. high) logic level, and as a result the output from each OR gate 23 in the anode switch circuit 18 is forcibly held at the H level during the $t_0$ interval. As a result, all of the anode switches are held in the ON state. During that ON state condition, i.e. while the charging signal is at the H level, a potential of 200 V applied from a power source produces a flow of charging current which passes through the output transistor 24b of each anode, into the corresponding anode capacitor 4a and the corresponding stray capacitance 12, thereby charging these capacitors towards +200 V. When the charging signal falls to the L (i.e. low ) level at the end of that $t_0$ blanking interval, the output transistor 24b in each of switching circuits 18a, 18b, . . . ,18z is set either to the ON or to the OFF state in accordance with the corresponding data output signal from latch circuit 19. The corresponding display elements of the next cathode to be scanned, i.e. cathode 7d, are thereby set to the light-emitting or non-light emitting states in accordance with the display data.

The operation during scanning of each of the other cathodes is identical to that for cathodes *7c* and *7d* described above.

If a gas discharge display apparatus of the form described above is designed for high-resolution display, then only a small spacing will be provided between adjacent ones of the anodes *2a, 2b*, . . . will be spaced very closely together. Thus, the spacings between successive dielectric partitioning members *8a, 8b*, . . . will also be very small. As a result, the charged particles and excitation atoms which are generated by the slight discharge process described above, i.e. resulting from discharge of an accumulation of charge upon capacitors and stray capacitances coupled to the respective anodes, will readily recombine and be thereby eliminated. In addition, the diffusion resistance between adjacent electrode intersection regions will tend to be high, so that generation of the slight discharge will not occur in a stable manner, i.e. may occur only intermittently. Furthermore, in the case of a high-resolution gas discharge display panel there will be a relatively large amount of mutual capacitive coupling between the anodes, and this further tends to extinguish the slight discharge described above. Referring to FIG. 5 and assuming for example that the displaying discharge state is established at the intersection region between electrodes *2b* and *7d*, which will be referred to as the region (*2b·7d*) and that the slight discharge state is established in the region (*2c·7d*) between anode *2c* and cathode *7d*, then the charged particles and excitation atoms which should preferably diffuse to the next intersection regions to be scanned, i.e. regions (*2b·7e*) and (*2c·7e*) will in fact almost entirely diffuse into the intersection region (*2b·7e*) rather than into region (*2c·7e*). Furthermore since the amount of capacitance $C_{sa}$ between the anodes is substantial, the slight discharge which should occur in the intersection region (*2c·7e*) will tend to flow into the inter-anode capacitance $C_{sa}$ and hence into the intersection region (*2b·7e*). As a result, generation of the slight discharge at the intersection region (*2c·7e*) may occur only intermittently, or may fail to occur.

It would be possible to overcome the problem described above, i.e. failure or intermittent occurrence of the slight discharge condition, by increasing the value of capacitance of the capacitors *4a* which are internally provided within the gas discharge display panel and connected to respective ones of the anodes *2a, 2b*, . . . , and by increasing the level of load resistance through which the slight discharge must flow. However if the value of capacitance of the capacitors *4a* is increased, then these capacitors will occupy a substantial amount of display area of the gas discharge display panel. Thus, the display utilization efficiency will be lowered, and manufacturing costs will be increased.

SUMMARY OF THE INVENTION

It is an objective of the present invention to provide a gas discharge display apparatus which overcomes the problems described above, by ensuring that occurrence of the slight discharge state is reliably established, irrespective of the effects of inter-cathode capacitance, and without the necessity for connecting capacitors of substantially high capacitance value to each of the anodes of the gas discharge display panel to ensure such reliable establishment of the slight discharge state.

To achieve this objective, a gas discharge display apparatus according to the present invention comprises:

a gas discharge display panel comprising first and second plate members disposed with a surface of the first plate member closely adjacent and parallel to a surface of the second plate member, with at least one of the plate members being formed of an optically transparent material, an array of elongated stripe-shaped anodes formed on the surface of the first plate member, an array of elongated stripe-shaped cathodes formed on the surface of the second plate member and oriented at right angles to the anodes to thereby define an array of display elements at regions of intersection between the anodes and cathodes, and an array of elongated dielectric partitioning members oriented parallel to the anodes and respectively disposed between mutually adjacent pairs of the anodes;

cathode switching circuit means responsive to an externally applied horizontal sync signal for sequentially connecting each of the cathodes to a cathode selection potential during respective cathode scanning intervals, in synchronism with the horizontal sync signal;

latch circuit means for storing display data to be displayed above successive ones of the cathodes during successive ones of the cathode scanning intervals;

anode switching circuit means responsive to the display data in the latch circuit means for applying an anode activation potential to selected ones of the anodes in accordance with the display data during each of the cathode scanning intervals, the cathode selection potential and anode activation potential being determined such as to produce a display discharge state when applied simultaneously to one of the anodes and the cathodes defining one of the display elements, whereby light is emitted from the display element;

charging signal generating circuit means for producing a charging signal, in synchronism with the horizontal sync signal, during a blanking interval preceding each of the cathode scanning intervals, the anode switching circuit means being coupled to receive the charging signal and responsive thereto for applying the anode activation potential to all of the anodes during the blanking interval, for thereby charging stray capacitances which are associated with the anodes, and;

circuit means for generating a support signal in synchronism with the horizontal sync signal during each of the cathode scanning intervals, the anode switching circuit means being coupled to receive the support signal and responsive thereto for applying the anode activation potential to all of the anodes during a time interval of fixed duration which is substantially shorter than the cathode scanning interval and which commences after a fixed time interval following the commencement of the cathode scanning interval.

DESCRIPTION OF THE PREFERRED EMBODIMENTS

Figure 6:
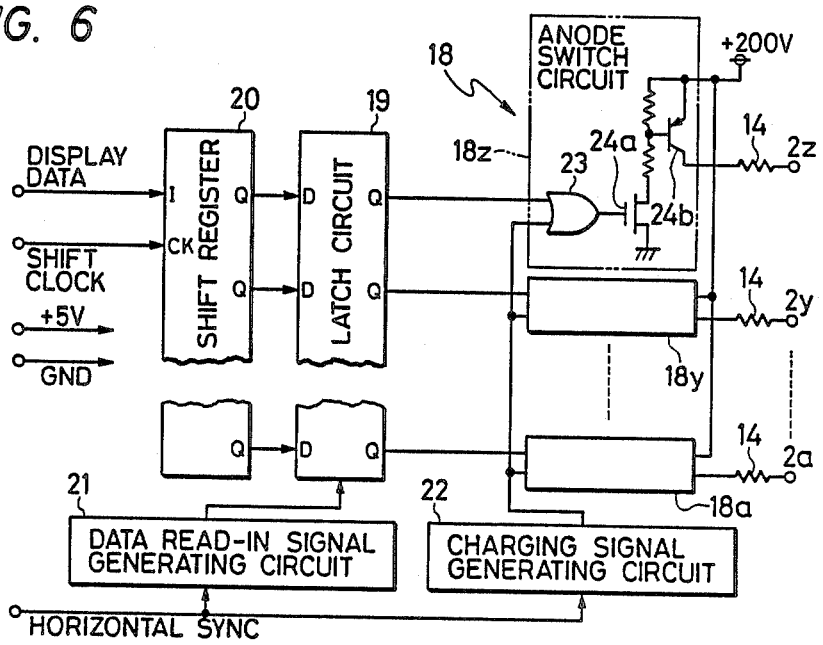
FIG. 6 is a circuit diagram of a part of the circuit of FIG. 5, for illustrating the configuration of an anode switch circuit.
Figure 7:
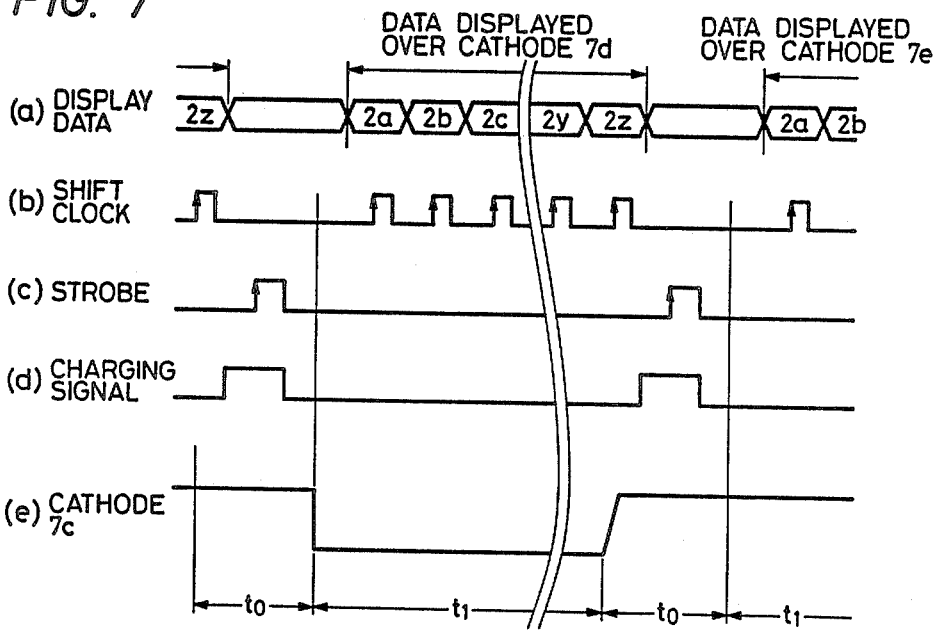
FIG. 7 is a waveform diagram for illustrating the operation of the circuit of FIGS. 5 and 6.
Figure 8:
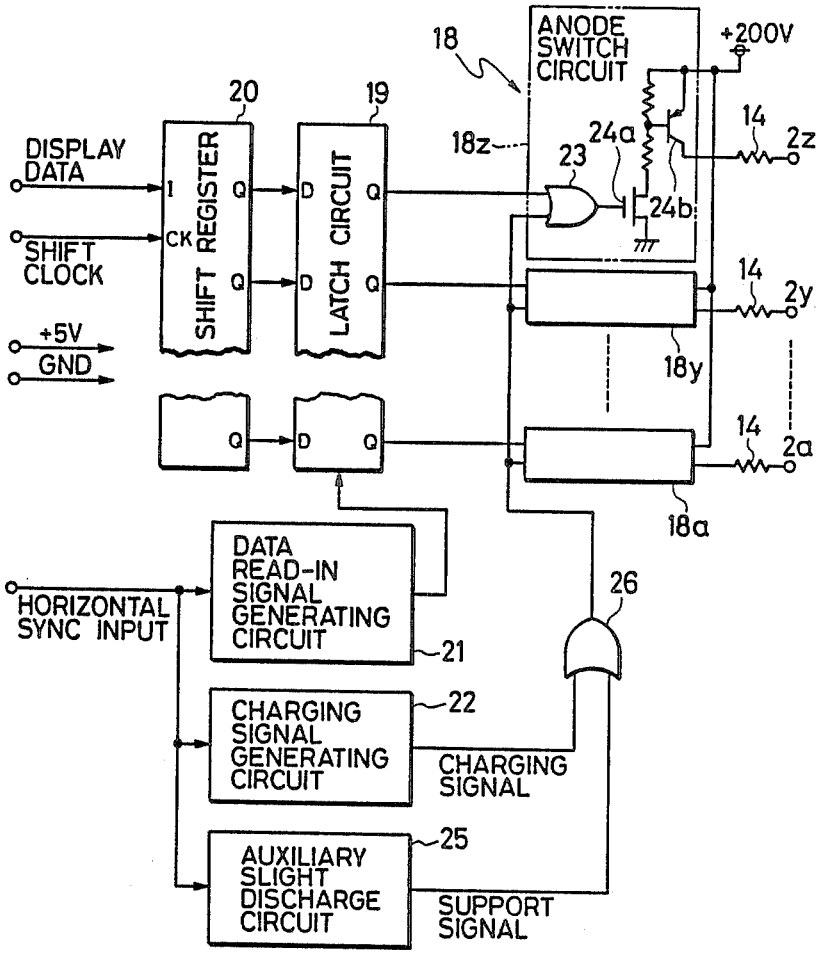
FIG. 8 is a circuit diagram of an essential portion of a gas discharge display apparatus according to the present invention.

FIG. 8 is a block circuit diagram of a portion of a drive circuit of an embodiment of a gas discharge display apparatus according to the present invention. Circuit blocks and components corresponding to those of FIG. 6 described above are indicated by identical reference numerals. The essential feature of difference between a gas discharge display apparatus according to the present invention and an apparatus according to the prior art as described hereinabove lies in the incorporation of an auxiliary slight discharge circuit 25 and an OR gate 26. The auxiliary slight discharge circuit 25 is coupled to receive the horizontal sync signal, and produces as output a signal which will be referred to in the following as a support signal. The support signal consists of a pulse train in which one pulse occurs during each of the $t_1$ intervals described hereinabove. The support signal is applied to one input of OR gate 26 and the charging signal produced from charging signal generating circuit 22 is applied to the other input of OR gate 26. The resultant output signal from OR gate 26 is input to each of the OR gates 23 in the respective switch circuits 18*a*, 18*b*, . . . ,18*z* constituting switch circuit 18.

The auxiliary slight discharge circuit 25 can be configured from a delay circuit and a one-shot multivibrator. Since circuit arrangements to generate the charging signal waveform (described in detail hereinafter) are well known in the art, a detailed description of the circuit of auxiliary slight discharge circuit 25 will be omitted.

As will be made clear in the following, it may in some cases be possible to omit the internally provided anode capacitors 4*a* within a display panel of a gas discharge display apparatus according to the present invention, although such capacitors are essential with prior art types of such display apparatus. However it will be assumed for the purposes of description of the present embodiment that such anode capacitors are incorporated.

Figure 9:
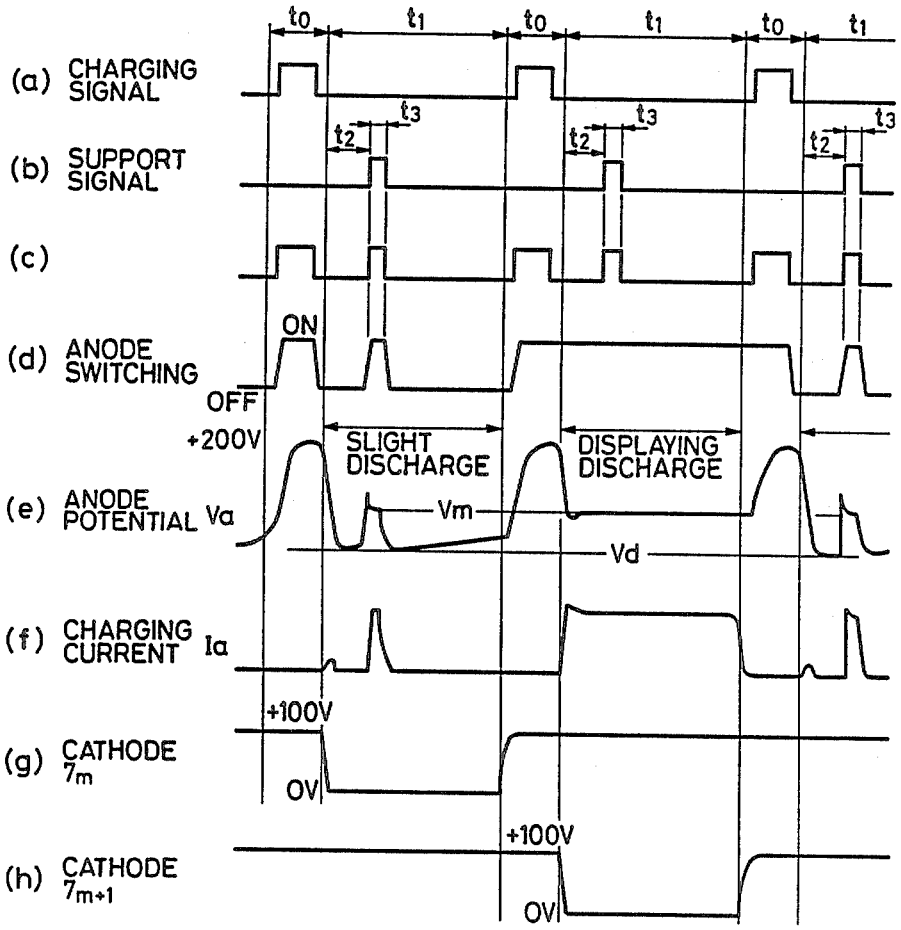
FIG. 9 is a waveform diagram for illustrating the operation of the circuit of FIG. 8.

FIG. 9 is a waveform diagram to illustrate the operation of the circuit of FIG. 8. The timing relationships between the support signal and the charging signal are illustrated by FIG. 9(*a*) and 9(*b*). As shown, the support signal comprises a train of positive-going pulses each of which begins after a time interval $t_2$ following the start of each of the cathode selection intervals $t_1$, and has a duration $t_3$ (as indicated in FIG. 9(*b*)). The resultant signal which is output from OR gate 26 is shown in FIG. 9(*c*). The output transistors 24*b* in each of the switch circuits 18*a*, 18*b*, . . . , 18*z* are set in the ON state by the charging signal pulse occurring within time interval $t_0$. During each time interval $t_1$, if the data output from latch circuit 19 applied to one of switch circuits 18*a*, 18*b*, . . . , 18*z* is at the L logic level, then the output transistor 24*b* of that switch circuit will only be set to the ON state within that $t_1$ interval for the duration of time interval $t_3$, i.e. during the support signal pulse.

The potentials of an arbitrarily selected pair of mutually adjacent cathodes, which will be designated as cathodes $7_m$ and $7_{m+1}$, will be assumed to be as shown in FIGS. 9(*g*) and 9(*h*), during the two cathode ON potential $t_1$ intervals shown in FIG. 9. During the first of these $t_1$ intervals, the potential of cathode 7*m* falls to the ON potential (i.e. 0 V), whereby the stray anode capacitances and the anode capacitors provided within the display panel become discharged shortly after the commencement of that $t_1$ interval, as illustrated in FIG. 9(*e*). Next, during time interval $t_3$, the anode switch (i.e. the corresponding output transistor 24*b*) is set in the ON state. As a result, a charging current flows through the corresponding anode coupling resistor 14 and between cathode 7*m* and the corresponding anode during a short time interval, i.e. corresponding to interval $t_3$, as shown in FIG. 9(*f*). This current flow is terminated immediately following the end of time interval $t_3$. In this way an auxiliary slight gaseous discharge occurs during a brief time interval within each of the cathode ON intervals $t_1$, between that cathode and all of the anodes which are not switched to the ON state (i.e. whose output transistors 24*b* are not set to the ON state in accordance with display data during that $t_1$ interval). This auxiliary slight discharge between anode and cathode occurs immediately following the slight discharge which is produced by discharging the anode capacitance and which also occurs with a prior art gas discharge display apparatus as described hereinabove.

As a result of this auxiliary slight discharge between anode and cathode, large amounts of charged particles and excitation atoms are produced which diffuse between a cathode which is currently being scanned and the cathode which is the next to be scanned (during the next horizontal scanning interval). In this way, the slight discharge state is always reliably established.

Figure 5:
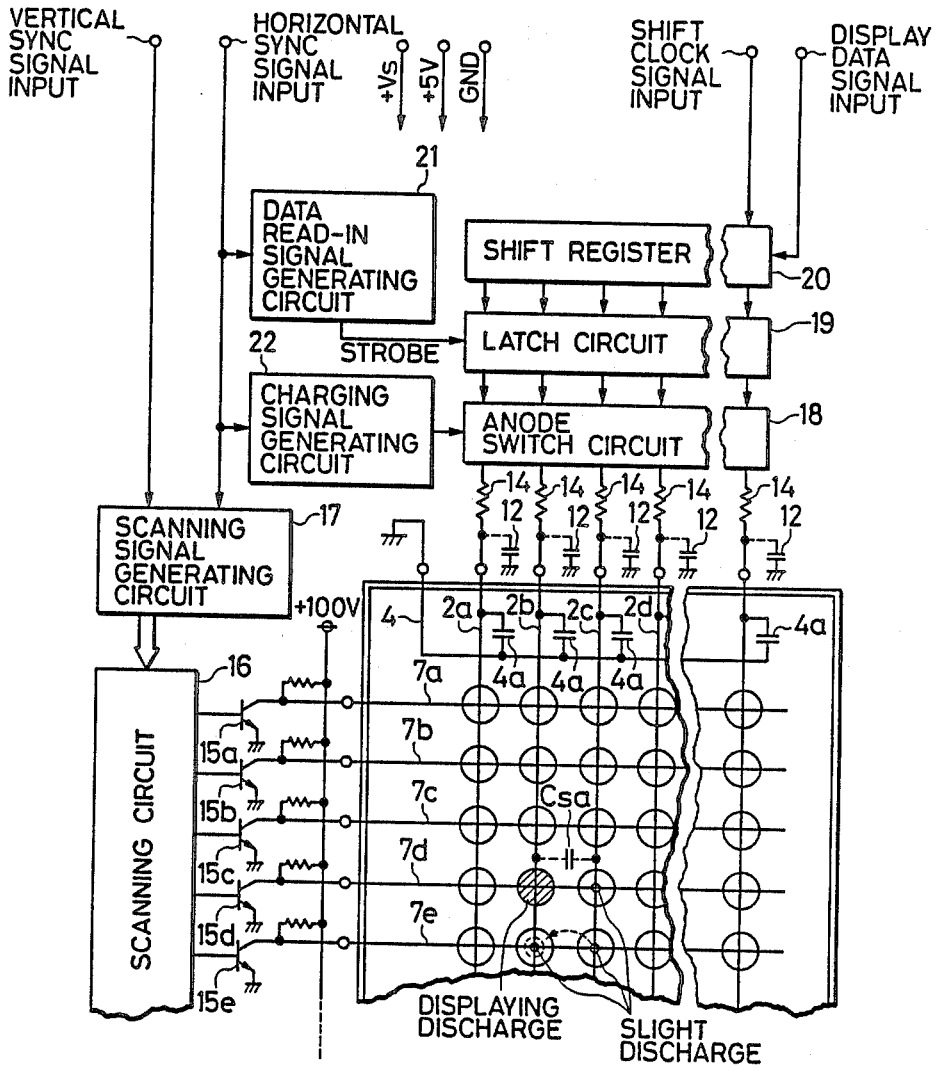
FIG. 5 is a block circuit diagram of an example of a drive circuit of a prior art gas discharge display apparatus.

If the amount of anode stray capacitance is relatively large, then it will be unnecessary to provide capacitors which are coupled to the respective anodes for the purpose of inducing the slight discharge state, i.e. capacitors 4*a*, 4*b*, . . . in the example of FIG. 5 can be eliminated.

In addition, the large amounts of charged particles and excitation atoms which are produced by the auxiliary slight discharge current flow has the effect of reducing delays in the initiation of charging current flow.

The duration of time interval $t_2$ must be sufficiently long to ensure that the initial slight discharge current flow (resulting from discharge of anode capacitance) has been completed. The duration of time interval $t_3$, i.e. the time for which the support signal pulse remains at the H logic level, can be adjusted as required to adjust the value of the auxiliary slight discharge current to a suitable level. If interval $t_3$ is made excessively long, then this will result in a reduction of display contrast, since a visually detectable level of light will be emitted from display elements which should be in the OFF, i.e. non-emissive state, i.e. the ratio of light emitted during the displaying discharge state and the slight discharge state will become excessively low.

If on the other hand time interval $t_3$ is made too short, then it will not be possible to attain the objectives of the present invention.

As the peak value of the discharge current flow between cathodes and anodes is increased, the overall display brightness will be increased. However if this peak current is made excessively high, the operating life of the display panel will be reduced due to deterioration of the cathodes.

Figure 1:
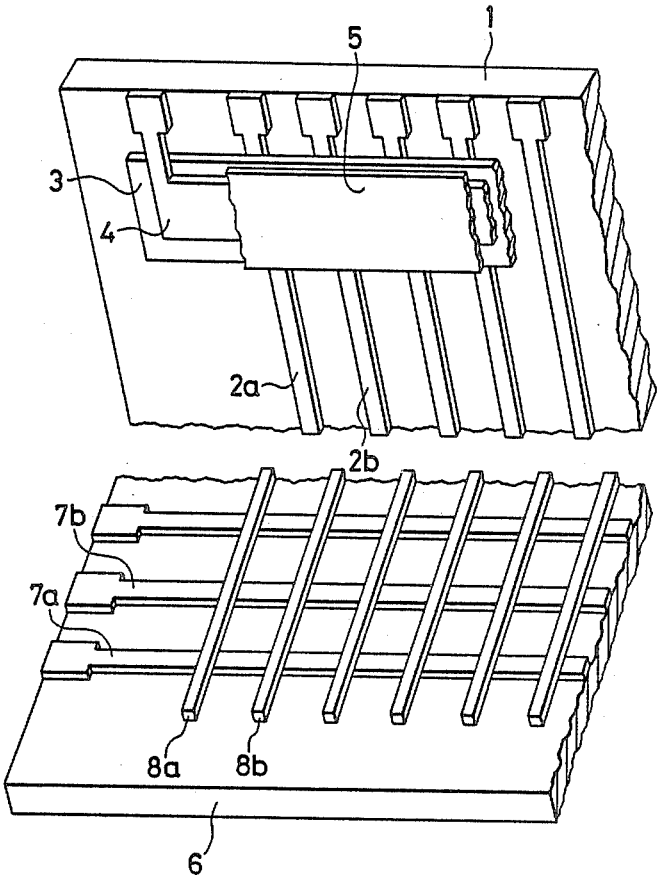
FIG. 1 PRIOR ART
FIG. 1 is a partial expanded oblique view of a gas discharge display panel.
Figure 2:
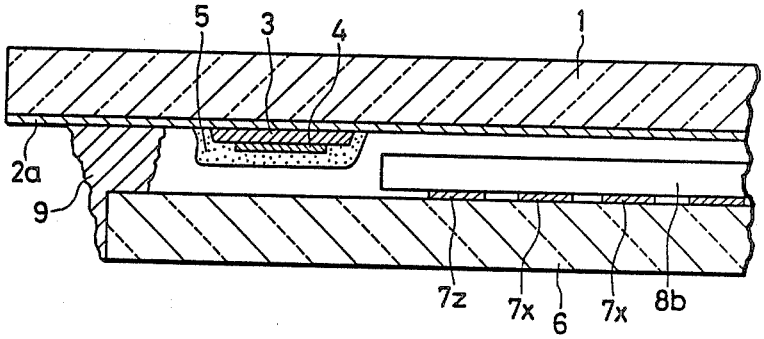
FIG. 2 PRIOR ART
FIG. 2 is a partial view in cross-section of the display panel of FIG. 1.
Figure 3:
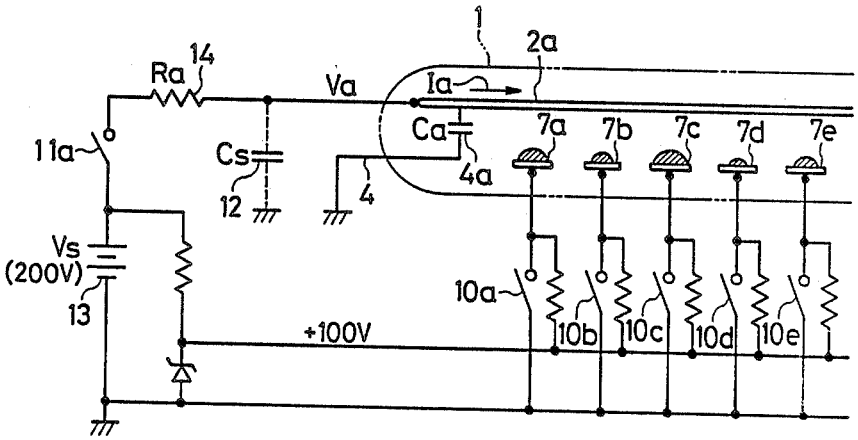
FIG. 3 PRIOR ART
FIG. 3 is a simplified circuit diagram for assistance in describing the basic operation of a gas discharge display apparatus according to the prior art.
Figure 4:
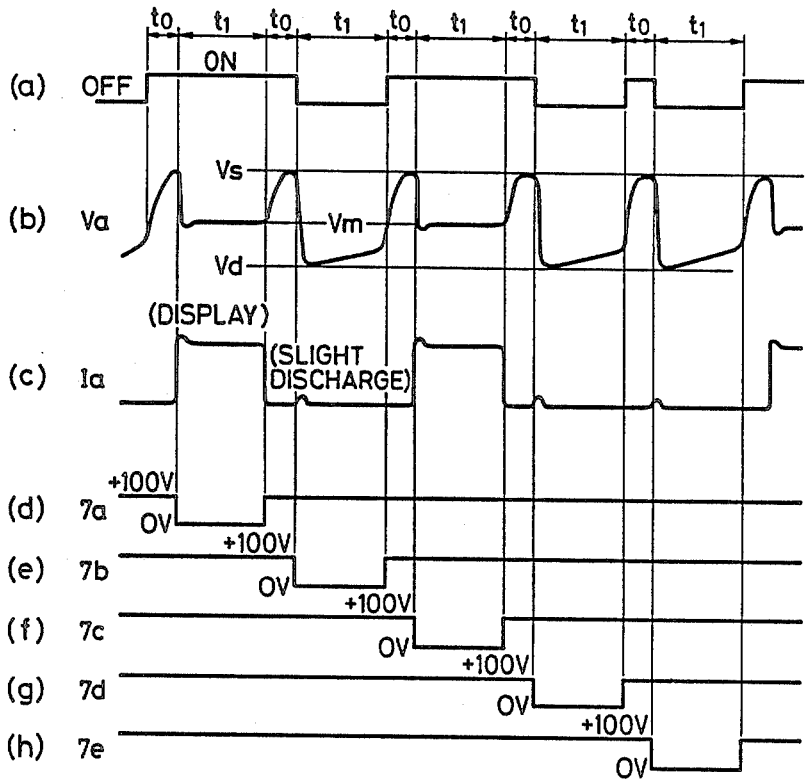
FIG. 4 is a waveform diagram for illustrating the operation of the circuit of FIG. 3.
Figure 10:
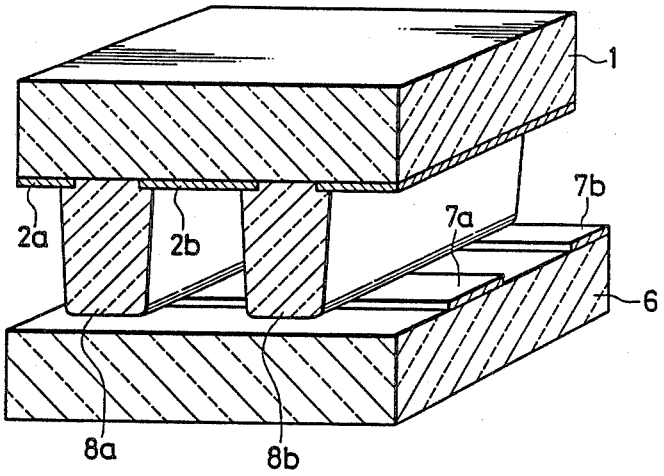
FIG. 10 is a partial oblique view of a portion of an embodiment of a gas discharge display panel for a display apparatus according to the present invention.

The design of a gas discharge display panel for a gas discharge display apparatus according to the present invention may be similar to that shown in FIG. 1 and described hereinabove. However as stated above it may be possible to omit the internally provided capacitors coupled to the anodes of such a display panel, i.e. it may be possible to omit the components 3, 4 and 5 shown in FIG. 1. It should be noted that it is important that the gas discharge display panel be designed such as to efficiently utilize the charged particles and excitation atoms which are produced during the slight discharge state. FIG. 10 shows a partial oblique view in cross-section of another embodiment of a gas discharge display panel in accordance with the present invention. In this display panel, partition members 8*a*, 8*b*, . . . are mounted upon an inner surface of a glass faceplate 1, while a separation of approximately 0.04 mm is provided between the partition members 8*a*, 8*b*, . . . and the inner surface of a rear glass plate 6. It can thus be understood that a plurality of elongated cells are formed between adjacent pairs of the partition members 8*a*, 8*b*, . . . , and that the regions of intersection between cathodes 7*a*, 7*b*, . . . and anodes 2*a*, 2*b*, . . . are all disposed within these cells. As a result of this configuration, cross-talk interference between adjacent intersection regions of a cathode and the anodes, (i.e. due to the establishment of the displaying discharge state in one region affecting an adjacent region which is set in the slight discharge state) is effectively reduced. Furthermore, the diffusion of charged particles and excitation atoms from an intersection region (positioned over a cathode which has been scanned) to an adjacent region (positioned over the next cathode to be scanned in the horizontal scanning sequence) is efficiently accomplished, thereby increasing the reliability of establishing the slight discharge state.

Although the present invention has been described in the above with reference to specific embodiments, it should be noted that various changes and modifications to the embodiments may be envisaged, which fall within the scope claimed for the invention as set out in the appended claims. The above specification should therefore be interpreted in a descriptive and not in a limiting sense.

What is claimed is:

1. A gas discharge display apparatus comprising:

a gas discharge display panel comprising first and second plate members disposed with a surface of said first plate member closely adjacent and parallel to a surface of said second plate member, with at least one of said plate members being formed of an optically transparent material, an array of elongated stripe-shaped anodes formed on said surface of said first plate member, an array of elongated stripe-shaped cathodes formed on said surface of said second plate member and oriented at right angles to said anodes to thereby define an array of display elements at regions of intersection between said anodes and cathodes, and an array of elongated dielectric partitioning members oriented parallel to said anodes and respectively disposed between mutually adjacent pairs of said anodes;

cathode switching circuit means responsive to an externally applied horizontal sync signal for sequentially connecting each of said cathodes to a cathode selection potential during respective cathode scanning intervals, in synchronism with said horizontal sync signal;

latch circuit means for storing display data to be displayed above successive ones of said cathodes during successive ones of said cathode scanning intervals;

anode switching circuit means responsive to said display data in said latch circuit means for applying an anode activation potential to selected ones of said anodes in accordance with said display data during each of said cathode scanning intervals, said cathode selection potential and anode activation potential being determined such as to produce a display discharge state when applied simultaneously to one of said anodes and said cathodes defining one of said display elements, whereby light is emitted from said display element;

charging signal generating circuit means for producing a charging signal, in synchronism with said horizontal sync signal, during a blanking interval preceding each of said cathode scanning intervals, said anode switching circuit means being coupled to receive said charging signal and responsive thereto for applying said anode activation potential to all of said anodes during said blanking interval, for thereby charging stray capacitances which are associated with said anodes, and;

circuit means for generating a support signal in synchronism with said horizontal sync signal during each of said cathode scanning intervals, said anode switching circuit means being coupled to receive said support signal and responsive thereto for applying said anode activation potential to all of said anodes during a time interval of fixed duration which is substantially shorter than said cathode scanning interval and which commences after a fixed time interval following the commencement of said cathode scanning interval.

2. A gas discharge display apparatus according to claim 1, and further comprising a plurality of a capacitors coupled between respective ones of said anodes and a fixed potential.

3. A gas discharge display apparatus according to claim 2, in which said capacitors are contained within said gas discharge display panel.

4. A gas discharge display apparatus according to claim 1, in which said dielectric partitioning members are fixedly mounted upon said surface of said first plate member, extending towards said surface of said second plate member and with a minute spacing being formed between each of said dielectric partitioning members and said surface of said second plate member.

* * * * *